US010729210B1

(12) United States Patent
Sano

(10) Patent No.: US 10,729,210 B1
(45) Date of Patent: Aug. 4, 2020

(54) WATCHBAND SECUREMENT WITH CLAMP PADS

(71) Applicant: Apple Inc., Cupertino, CA (US)

(72) Inventor: Tatsuya Sano, San Jose, CA (US)

(73) Assignee: Apple Inc., Cupertino, CA (US)

( * ) Notice: Subject to any disclaimer, the term of this patent is extended or adjusted under 35 U.S.C. 154(b) by 220 days.

(21) Appl. No.: 15/608,900

(22) Filed: May 30, 2017

(51) Int. Cl.

| | |
|---|---|
| ***A44B 11/00*** | (2006.01) |
| ***A44C 5/20*** | (2006.01) |
| ***A44C 5/18*** | (2006.01) |
| ***A44C 5/00*** | (2006.01) |
| ***A44C 5/24*** | (2006.01) |

(52) U.S. Cl.
CPC ..... *A44C 5/20* (2013.01); *A44C 5/0053* (2013.01); *A44C 5/18* (2013.01); *A44C 5/2071* (2013.01); *A44C 5/246* (2013.01); *A44C 5/00* (2013.01)

(58) Field of Classification Search
CPC ..... Y10T 24/3949; Y10T 24/4782; Y10T 24/3996; Y10T 24/3947; Y10T 24/3969; A44C 5/20; A44C 5/18; A44C 5/2071; A44C 5/246; F16G 11/00; F16G 11/02
See application file for complete search history.

(56) References Cited

U.S. PATENT DOCUMENTS 3,034,189 A * 5/1962 Twentier ..... A44C 5/18 2/322
3,410,525 A * 11/1968 Tanson ..... B66D 3/02 24/134 N
3,824,653 A * 7/1974 Sholler ..... F16G 11/105 24/134 KB
3,911,535 A * 10/1975 Mauron ..... B60R 22/1855 24/170
3,916,487 A * 11/1975 Rinio ..... B66D 3/02 24/122.6
3,923,333 A * 12/1975 Whaley ..... B66C 1/48 294/104
3,992,757 A * 11/1976 Danna ..... A44B 11/28 24/311
4,450,603 A * 5/1984 Hirsch ..... B63B 21/18 224/103
4,669,582 A * 6/1987 Sandreid ..... F16G 11/106 188/65.1
5,083,350 A * 1/1992 Sandreid ..... F16G 11/101 24/134 N
5,176,106 A * 1/1993 Casto ..... A01K 27/005 119/865
5,279,020 A * 1/1994 Coe ..... F16G 11/101 24/132 WL (Continued)

*Primary Examiner* — Jason W San
(74) *Attorney, Agent, or Firm* — Morgan, Lewis & Bockius LLP

(57) ABSTRACT

A watchband can comfortably secure an electronic device to a wrist of a user. A connector can be provided along a segment of the watchband to receive and secure to another segment of the watchband. For example, a connector can include a housing with an inlet and an outlet, a first pad within the housing, and a second pad within the housing. When a watchband segment between the first and second pads is moved in a direction from the outlet toward the inlet, the first pad and the second pad move toward each other to clamp the watchband segment without plastically deforming the watchband segment.

18 Claims, 9 Drawing Sheets

(56) References Cited

U.S. PATENT DOCUMENTS

| | | | | |
|---|---|---|---|---|
| 5,870,803 | A * | 2/1999 | Jorst | A44B 11/28 24/265 BC |
| 6,276,580 | B1 * | 8/2001 | Kitahara | A44C 5/14 224/178 |
| 6,418,760 | B1 * | 7/2002 | Fettes | A45C 13/1053 24/167 |
| 6,457,215 | B1 * | 10/2002 | Martin | A44C 5/14 24/265 EC |
| D558,454 | S * | 1/2008 | Tracy | D3/318 |

* cited by examiner

WATCHBAND SECUREMENT WITH CLAMP PADS

TECHNICAL FIELD

The present description relates generally to securement of wearable devices, and, more particularly, to watchband securement with clamps.

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device to the user can depend on the function and arrangement of the watchband.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

An electronic device, such as a wristwatch or fitness/health tracking device, can be attached to a user's wrist by a watchband. It can be desirable to maintain a secure attachment to the wrist so that the electronic device does not shift excessively or slip off of the user. Securement of the electronic device against the user can also be important to the function of electronic components, such as biometric sensors. For comfort and aesthetic purposes, the watchband can include flexible materials, such as polymers and leather. Portions of the watchband can be somewhat susceptible to damage after repeated securement and release.

Adjusting the size or fit of conventional watchbands often requires multiple steps, specialized tools, and/or technical expertise. Sizing options available to a user may be insufficient to obtain a proper fit. The fit may be different and/or may be perceived to be different given certain environmental (e.g. temperature, humidity) or biological conditions (e.g., sweat, inflammation). As a result, users of conventional wristwatches and/or fitness/health tracking devices may select a tolerable (although not optimally comfortable) fit, reserving tight bands for fitness/health tracking devices and loose bands for conventional wristwatches. However, some wearable electronic devices may be multi-purpose devices, providing both fitness/health tracking and timekeeping functionality. Accordingly, a user may prefer the fit of a watch to vary with use. For example, a user may prefer a looser fit in a timekeeping mode and a tighter fit in a fitness/health tracking mode. Accordingly, dynamic adjustment of the fit of wearable electronic devices can be desired.

Embodiments of the present disclosure can enhance comfort by providing adjustability across a continuous scale of tightness. For example, the watchband can be adjusted to any length, rather than to one of a few discrete lengths. The attachment mechanisms can provide dynamic adjustment of a watchband with ease. The watchband can be repeatedly and securely fastened without damaging the watchband material over time.

Figure 1:
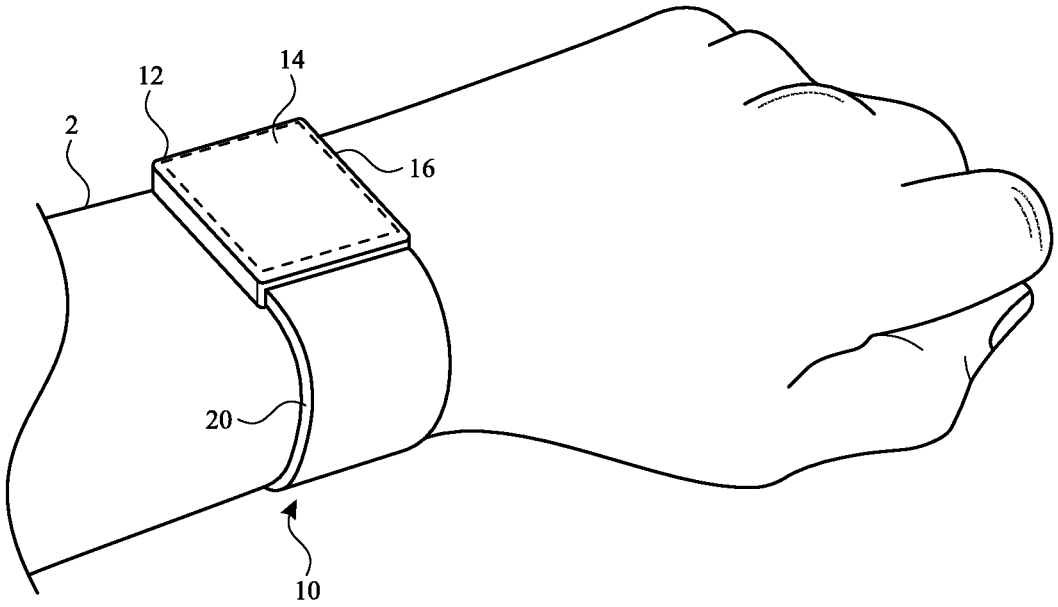
FIG. 1 is a perspective view of a watch on a wrist of a user, in accordance with some embodiments of the present disclosure.
Figure 2:
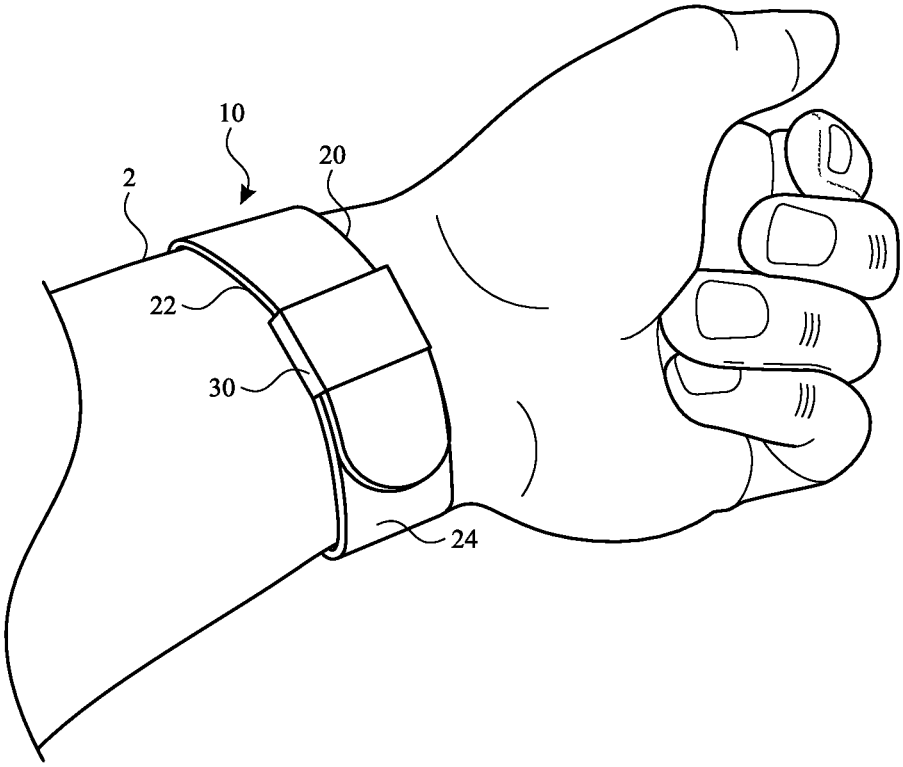
FIG. 2 is another perspective view of the watch of FIG. 1 on the wrist of the user, in accordance with some embodiments of the present disclosure.

According to some embodiments, for example as shown in FIG. 1, a watch 10 includes an electronic device 12 that is worn on a wrist 2 with a watchband 20. The electronic device 12 can be portable and also be attached to other body parts of the user or to other devices, structures, or objects. The watchband 20 can be flexible and encircle at least a portion of the wrist 2 of a user. By securing the electronic device 12 to the person of the user, the watchband 20 provides security and convenience. In some embodiments, the electronic device 12 includes a display 14 and a housing 16 for containing components. According to some embodiments, for example as shown in FIG. 2, the watchband 20 extends to an opposite side of the wrist 2 of user from electronic device 12. The watchband 20 includes a first watchband segment 22 and a second watchband segment 24 that overlap and engage each other with a connector 30.

Figure 3:
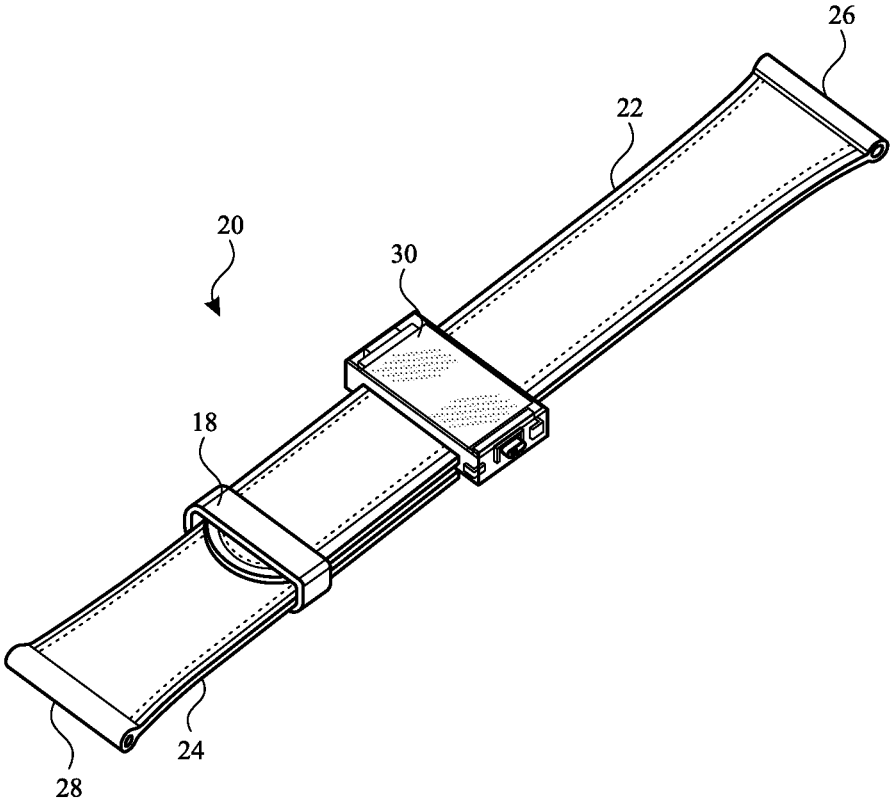
FIG. 3 is a perspective view of a watchband, in accordance with some embodiments of the present disclosure.

According to some embodiments, for example as shown in FIG. 3, the first watchband segment 22 extends into and through the connector 30. The watchband 20 is sized to fit securely and comfortably onto the wrist 2 by selecting an extent to which the first watchband segment 22 extends through the connector 30 and overlaps with the second watchband segment 24. A capture band 18 on the second watchband segment 24 retains the first watchband segment 22 when inserted therein. A user can insert at least a portion of the first watchband segment 22 through a portion of the capture band 18. The capture band 18 can then encompass a portion of the first watchband segment 22 and the second watchband segment 24. The first watchband segment 22 includes an end 26 for attaching to the housing 16 of the electronic device 12. The second watchband segment 24 includes an end 28 for attaching to the housing 16 of the electronic device 12.

Figure 4:
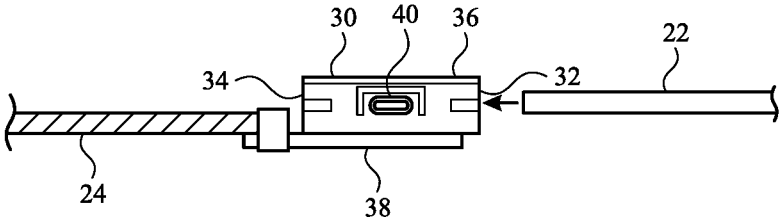
FIG. 4 is a side view of a connector and a watchband, in accordance with some embodiments of the present disclosure.

According to some embodiments, for example as shown in FIG. 4, the second watchband segment 24 is attached to a housing 36 of the connector 30, for example, with a base 38 of the connector 30. The first watchband segment 22 can be inserted into the connector 30 through an inlet 32 of the housing 36. The first watchband segment 22 can extend through the connector 30 to an outlet 34 of the housing 36. Accordingly, the watchband 20 can be removed from the electronic device 12 and replaced, thereby permitting a user to switch watchbands as necessary or desired. The connector 30 can also be provided with release buttons 40 for disengaging the first watchband segment 22 from within the connector 30, as described further herein.

Figure 5:
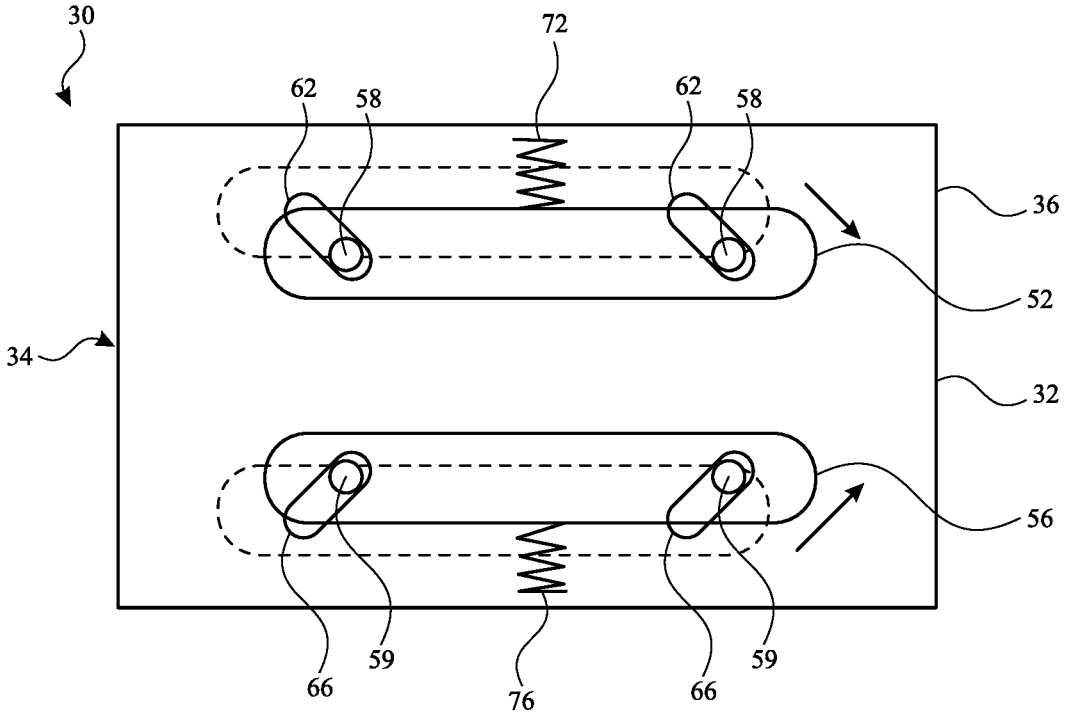
FIG. 5 is a schematic view of a connector, in accordance with some embodiments of the present disclosure.

According to some embodiments, for example as shown in FIG. 5, an upper pad 52 and a lower pad 56 are provided within the housing 36 of the connector 30. The upper pad 52 includes one or more upper pins 58 that slidably engage upper guide grooves 62. The lower pad 56 includes one or more lower pins 59 that slidably engaged lower guide grooves 66. The upper guide grooves 62 and/or the lower guide grooves 66 can be provided by or within the housing 36, so that the upper pad 52 and the lower pad 56 can slidably move with respect to the housing 36. The upper pad 52 and the lower pad 56 can be biased towards each other, for example within upper spring element 72 and a lower spring element 76, which can apply forces with respect to the housing 36 or another structure. The biasing forces urge the upper pad 52 and the lower pad 56 to slide toward each other as directed by the upper guide grooves 62 and the lower guide grooves 66.

Figure 6:
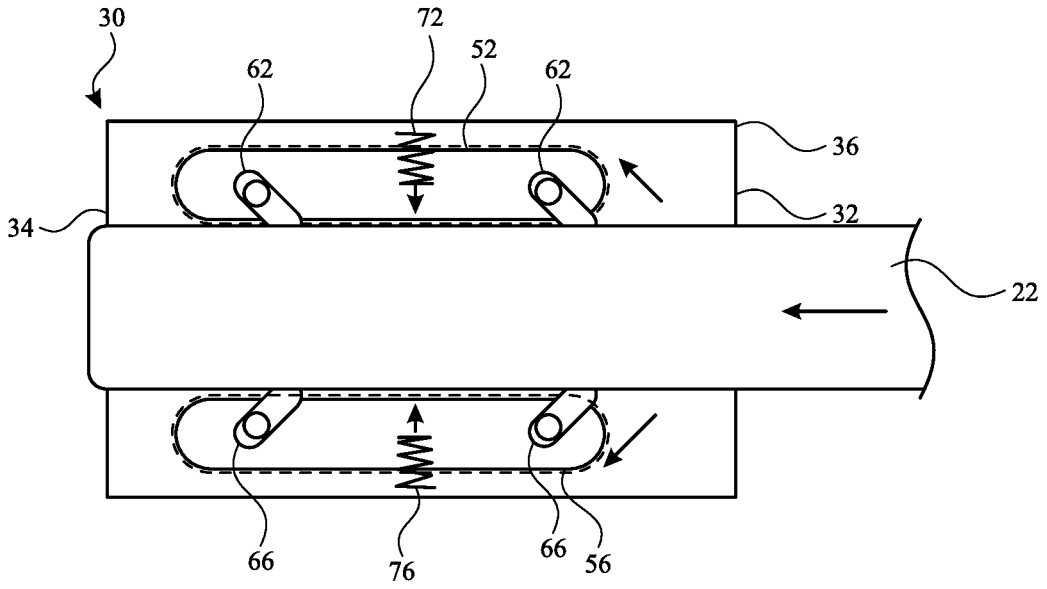
FIG. 6 is a schematic view of a connector and a watchband, in accordance with some embodiments of the present disclosure.

According to some embodiments, for example as shown in FIG. 6, the first watchband segment 22 can be provided through the inlet 32 of the housing 36 and towards the outlet 34. The insertion of the first watchband segment 22 urges the upper pad 52 and the lower pad 56 away from each other to accommodate entry of the first watchband segment 22. The upper pad 52 and the lower pad 56 can slide away from each other as directed by the upper guide grooves 62 and the lower guide grooves 66. The upper spring element 72 and the lower spring element 76 urge the upper pad 52 and the lower pad 56 into contact with the first watchband segment 22. While the first watchband segment 22 is at rest within the housing 36, contact forces applied by the upper pad 52 and the lower pad 56 to the first watchband segment 22 are insufficient to frictionally resist movement of the first watchband segment 22. For example, the first watchband segment 22 can continue toward the outlet 34 while the upper pad 52 and the lower pad 56 apply forces to the first watchband segment 22. Additionally, as the first watchband segment 22 moves toward the outlet 34, the upper pad 52 and the lower pad 56 can be moved in the same direction until the upper guide grooves 62 and the lower guide grooves 66 urge the upper pad 52 and the lower pad 56 away from each other and/or away from the first watchband segment 22.

Figure 7:
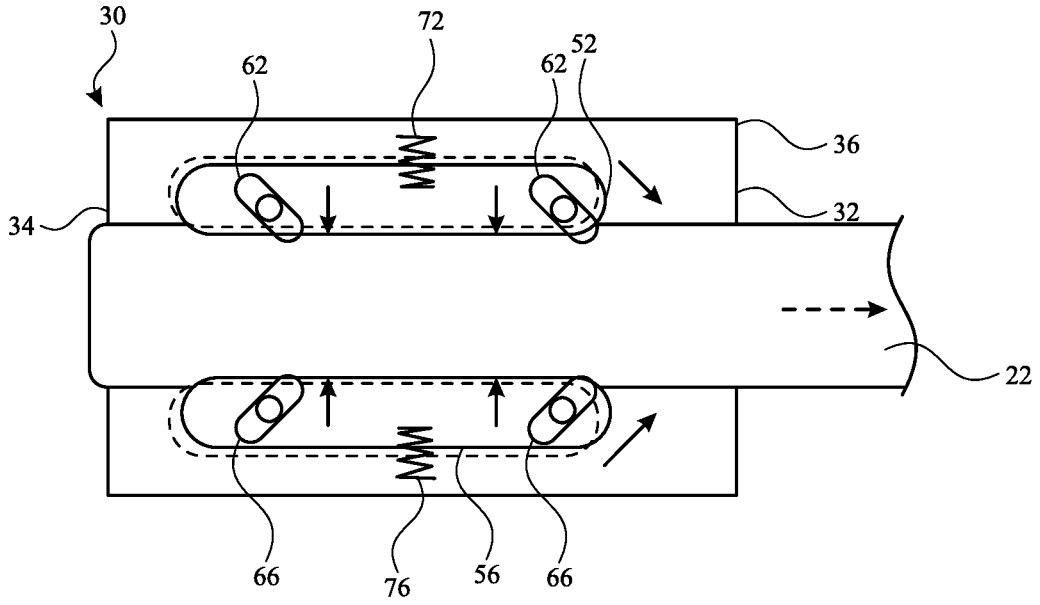
FIG. 7 is a schematic view of a connector and a watchband, in accordance with some embodiments of the present disclosure.

According to some embodiments, for example as shown in FIG. 7, the upper pad 52 and the lower pad 56 resist movement of the first watchband segment 22 out of the inlet 32. The upper spring element 72 and the lower spring element 76 bias the upper pad 52 and the lower pad 56 against the first watchband segment 22. As the first watchband segment 22 is moved toward the inlet 32 and away from the outlet 34, friction provided by the biasing force will tend to draw the upper pad 52 and the lower pad 56 along with the first watchband segment 22. As the upper pad 52 and the lower pad 56 move longitudinally toward the inlet 32 and away from the outlet 34, the upper guide grooves 62 and the lower guide grooves 66 direct the upper pad 52 and the lower pad 56 toward each other and against the first watchband segment 22. Accordingly, engagement forces are applied by the upper pad 52 and the lower pad 56 to the first watchband segment 22. The engagement forces are greater than the contact forces applied while the first watchband segment 22 is at rest within the housing 36. The upper pad 52 and the lower pad 56 clamp onto the first watchband segment 22 to resist movement of the first watchband segment 22 relative to the upper pad 52 and the lower pad 56. The engagement forces applied by the upper pad 52 and the lower pad 56 are distributed across contact surfaces at the upper pad 52 and the lower pad 56. For example, the total forces are distributed and the engagement forces are only applied when the first watchband segment 22 is pulled toward the inlet 32. At rest, no engagement forces are applied. Accordingly, the first watchband segment 22 is not damaged, torn, plastically deformed, or otherwise permanently altered. Instead, the first watchband segment 22 is engaged for a time, and after the first watchband segment 22 is released, it is restored to its shape and condition prior to engagement by the upper pad 52 and the lower pad 56.

Because the mechanism of the connector 30 does not require attachment to occur at particular locations along the length of the first watchband segment 22, the user can select any length to provide adjustability across a continuous scale of tightness. Furthermore, the selection of an appropriate length is simple, in that the user can insert the first watchband segment 22 until it reaches a comfortable level of tightness, at which point the connector automatically engages the first watchband segment 22 to maintain the selected level of tightness. As such, the connector 30 can operate as a one-way ratchet.

Figure 8:
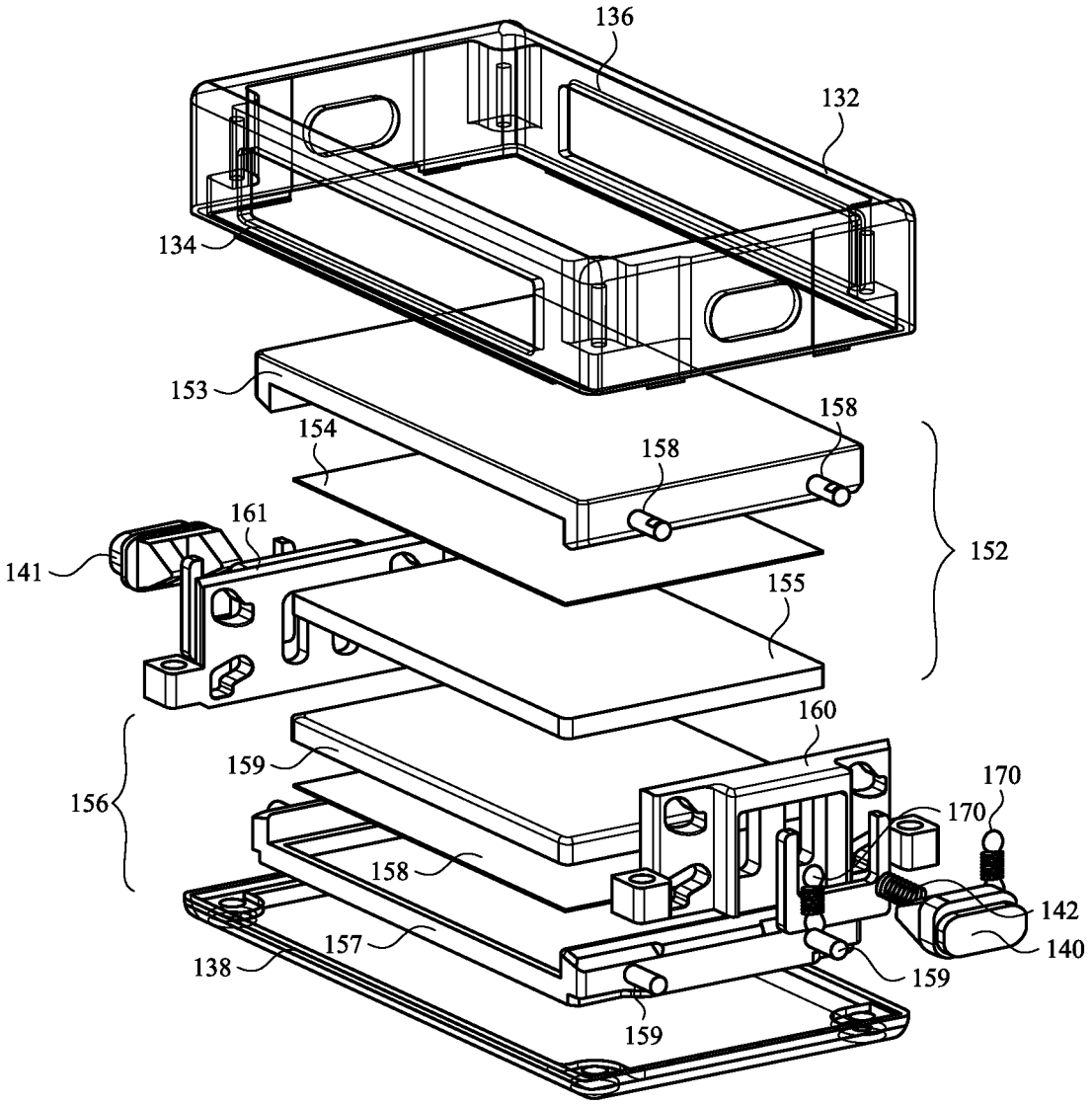
FIG. 8 is an exploded perspective view of a connector, in accordance with some embodiments of the present disclosure.

According to some embodiments, for example as shown in FIG. 8, a connector 130 can also be used to engage a watchband. The connector 130 can be similar in many respects to the connector 30 described above. For example, features of the connector 30 and the connector 130 can be combined in either or both of the connector 30 and the connector 130.

Figure 9:
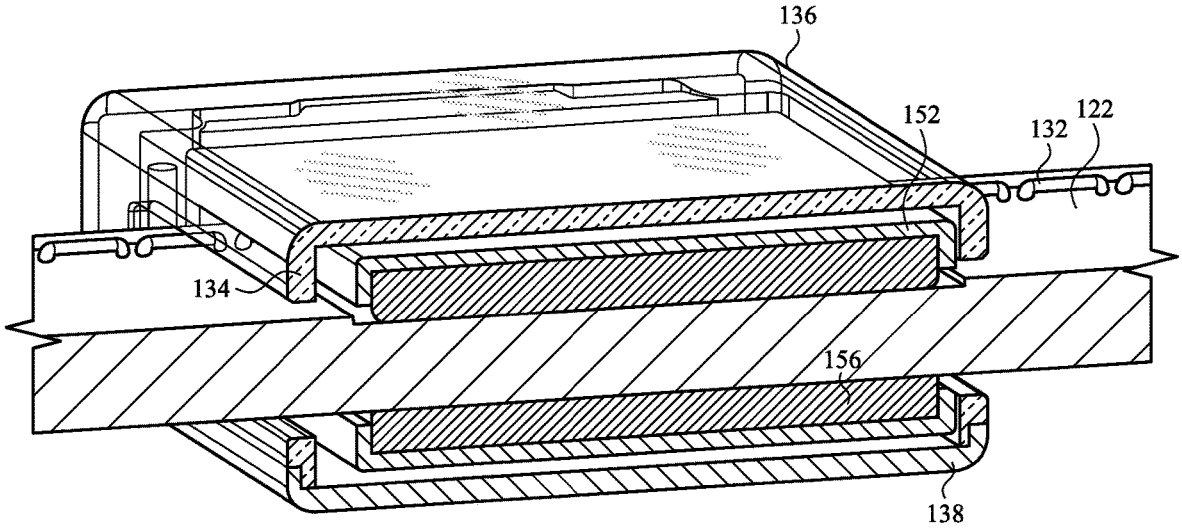
FIG. 9 is a perspective sectional view of a connector and a watchband, in accordance with some embodiments of the present disclosure.

As shown in FIGS. 8 and 9, the connector 130 includes a housing 136 that provides an inlet 132 and an outlet 134. An upper pad 152 and a lower pad 156 are provided within the housing 136. The upper pad 152 includes an upper escalator plate 153 and an upper engagement block 155, which can be attached to each other by an adhesive 154 and/or another attachment mechanism. The upper escalator plate 153 can be more rigid than the upper engagement block 155 and include one or more upper pins 149. The lower pad 156 includes a lower escalator plate 157 and a lower engagement block 159, which can be attached to each other by an adhesive 158 and/or another attachment mechanism. The lower escalator plate 157 can be more rigid than the lower engagement block 159 and include one or more lower pins 151. The upper engagement block 155 and the lower engagement block 159 can be of a flexible material with a coefficient of friction that facilitates engagement with a watchband segment without damaging the watchband segment. For example, the flexible material can include a polymer, such as rubber or silicone. The upper engagement block 155 and the lower engagement block 159 can be smooth or textured on contact surfaces thereof. The upper engagement block 155 and the lower engagement block 159 can be flat, planar, or a shape that is complementary to the first watchband segment 122, so that forces are evenly distributed across contact surfaces thereof. For example, an entirety of each contact surface that contacts or engages the first watchband segment 122 can be flat, planar, or a complementary shape. As such, no portion of the upper engagement block 155 and the lower engagement block 159 pierces or penetrates the first watchband segment 122 to achieve frictional engagement. The upper engagement block 155 and the lower engagement block 159 can be on a surface or within a recess of the upper escalator plate 153 or the lower escalator plate 157, respectively. The upper engagement block 155 and the lower engagement block 159 can be parallel to each other.

The connector 130 includes a first rail 160 and a second rail 161, opposite the first rail 160 within the housing 136. The first rail 160 and the second rail 161 can each provide upper and lower guide grooves for engagement by the upper pins 149 and the lower pins 151, as described further herein. The first rail 160 and the second rail 161 also provide access for a first release button 140 and a second release button 141 on opposite sides of the housing 136. The first release button 140 and the second release button 141 can each be biased to an outward position by a release button spring 142 between the corresponding release button and rail.

Figure 10:
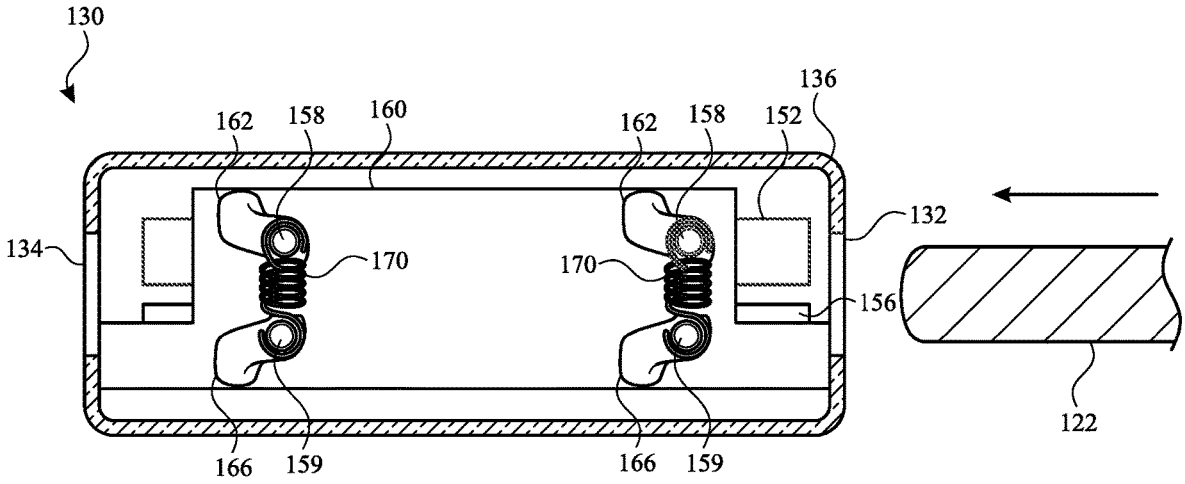
FIG. 10 is a sectional view of a connector and a watchband, in accordance with some embodiments of the present disclosure.

According to some embodiments, for example as shown in FIG. 10, the upper guide grooves 162 and/or the lower guide grooves 166 are provided by the first rail 160 and the second rail 161. The upper pins 149 of the upper pad 152 can slidably move within the upper guide grooves 162, and the lower pins 151 of the lower pad 156 can slidably move within the lower guide grooves 166. The upper pad 152 and the lower pad 156 can be biased towards each other, for example by spring elements 170 that each connects an upper pin 149 to a lower pin 151. The biasing forces urge the upper pad 152 and the lower pad 156 to slide toward each other and as directed by the upper guide grooves 162 and the lower guide grooves 166.

Figure 11:
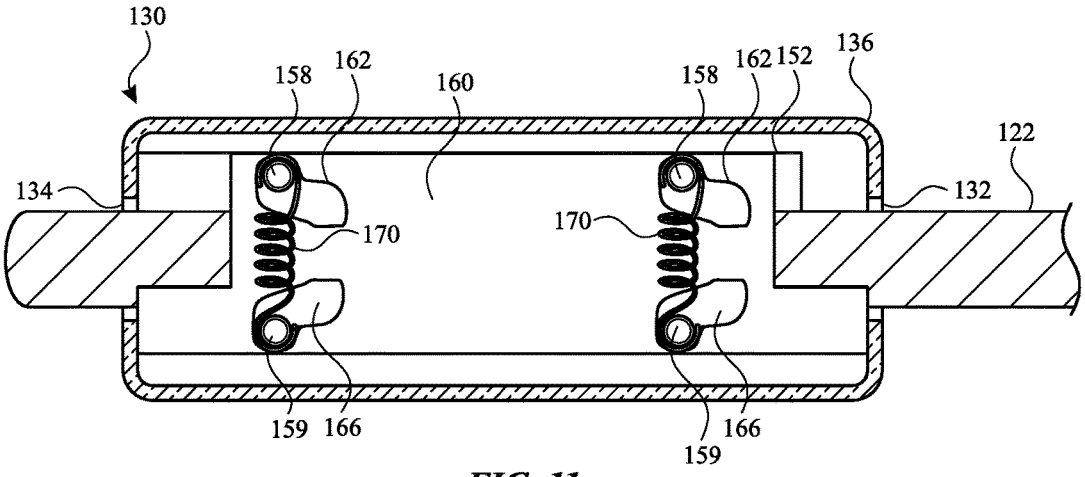
FIG. 11 is a sectional view of a connector and a watchband, in accordance with some embodiments of the present disclosure.
Figure 12:
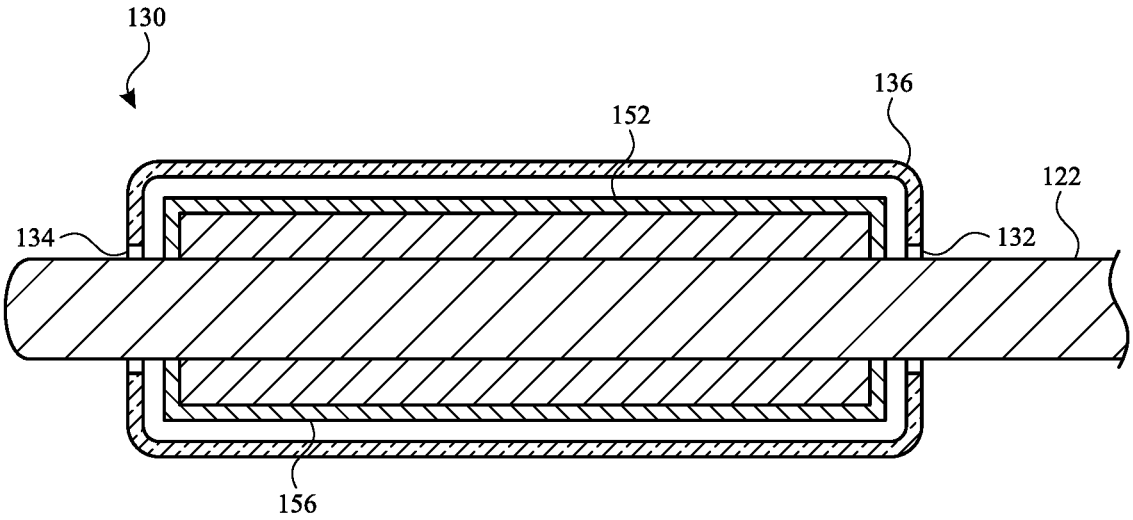
FIG. 12 is another sectional view of the connector and the watchband of FIG. 11, in accordance with some embodiments of the present disclosure.

According to some embodiments, for example as shown in FIGS. 11 and 12, the first watchband segment 122 is provided through the inlet 132 of the housing 136 and towards the outlet 134. The insertion of the first watchband segment 122 urges the upper pad 152 and the lower pad 156 away from each other to accommodate entry of the first watchband segment 122. The upper pad 152 and the lower pad 156 can slide away from each other as directed by the upper guide grooves 162 and the lower guide grooves 166. For example, the upper pins 149 and the lower pins 151 can move away from each other by sliding within the upper guide grooves 162 and the lower guide grooves 166. As shown in FIG. 11, outer portions of the upper guide grooves 162 and the lower guide grooves 166 can extend transverse to the first watchband segment 122 to allow the upper pins 149 and the lower pins 151 to move directly away from each other (e.g., vertically, rather than diagonally). The spring elements 170 urge the upper pad 152 and the lower pad 156 into contact with the first watchband segment 122. While the first watchband segment 122 is at rest within the housing 136, contact forces applied by the upper pad 152 and the lower pad 156 to the first watchband segment 122 are insufficient to frictionally resist movement of the first watchband segment 122. For example, the first watchband segment 122 can continue toward the outlet 134 while the upper pad 152 and the lower pad 156 apply forces to the first watchband segment 122. Additionally, as the first watchband segment 122 moves toward the outlet 134, the upper pad 152 and the lower pad 156 can be moved in the same direction until the first rail 160 and the second rail 161 urge the upper pins 149 and the lower pins 151 away from each other and/or away from the first watchband segment 122.

Figure 13:
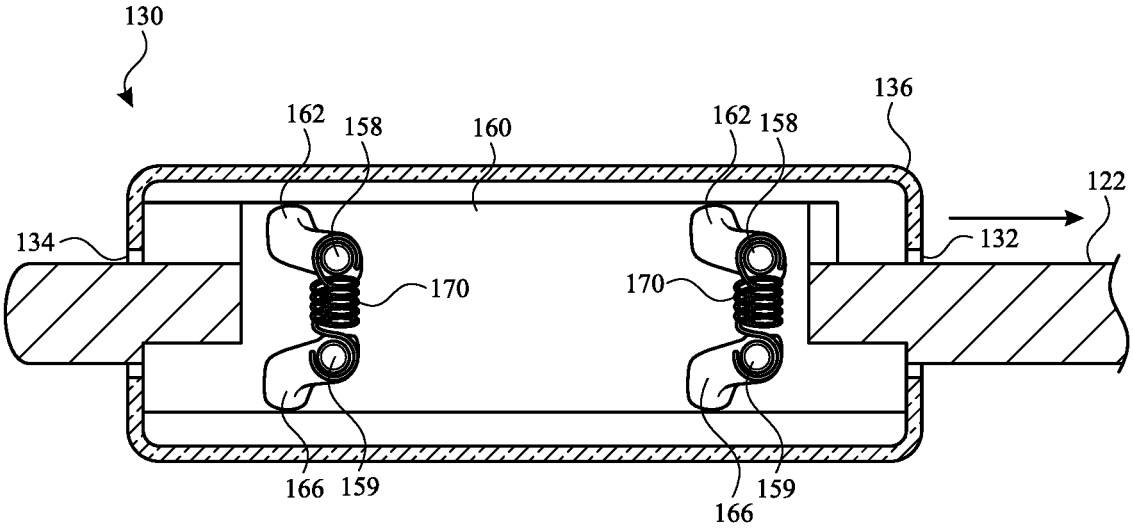
FIG. 13 is a sectional view of a connector and a watchband, in accordance with some embodiments of the present disclosure.
Figure 14:
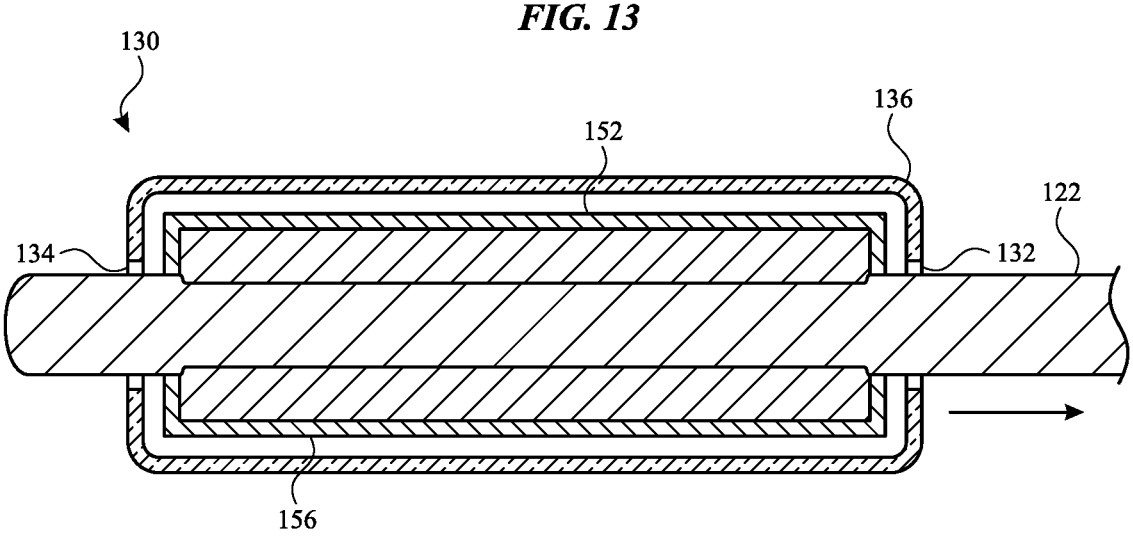
FIG. 14 is another sectional view of the connector and the watchband of FIG. 13, in accordance with some embodiments of the present disclosure.

According to some embodiments, for example as shown in FIGS. 13 and 14, the upper pad 152 and the lower pad 156 resist movement of the first watchband segment 122 out of the inlet 132. As the first watchband segment 122 is moved toward the inlet 132 and away from the outlet 134, friction provided by the biasing force and from the spring elements 170 will tend to draw the upper pad 152 and the lower pad 156 longitudinally along with the first watchband segment 122. As the upper pad 152 and the lower pad 156 move longitudinally toward the inlet 132 and away from the outlet 134, the first rail 160 and the second rail 161 direct the upper pins 149 and the lower pins 151 toward each other until the upper pad 152 and the lower pad 156 are against the first watchband segment 122. As shown in FIG. 13, inner portions of the upper guide grooves 162 and the lower guide grooves 166 can extend diagonally with respect to the first watchband segment 122 to allow the upper pins 149 and the lower pins 151 to move toward each other when moving toward the inlet 132 (e.g., diagonally, rather than only vertically). Accordingly, engagement forces are applied by the upper pad 152 and the lower pad 156 to the first watchband segment 122. The engagement forces are greater than the contact forces applied while the first watchband segment 122 is at rest within the housing 136. The upper pad 152 and the lower pad 156 clamp onto the first watchband segment 122 to resist movement of the first watchband segment 122 relative to the upper pad 152 and the lower pad 156. The engagement forces applied by the upper pad 152 and the lower pad 156 are distributed across contact surfaces at the upper pad 152 and the lower pad 156. For example, the total forces are distributed and the engagement forces are only applied when the first watchband segment 122 is pulled toward the inlet 132. At rest, no engagement forces are applied. Accordingly, the first watchband segment 122 is not damaged, torn, plastically deformed, or otherwise permanently altered. Instead, the first watchband segment 122 is engaged for a time, and after the first watchband segment 122 is released, it is restored to its shape and condition prior to engagement by the upper pad 152 and the lower pad 156.

Figure 15:
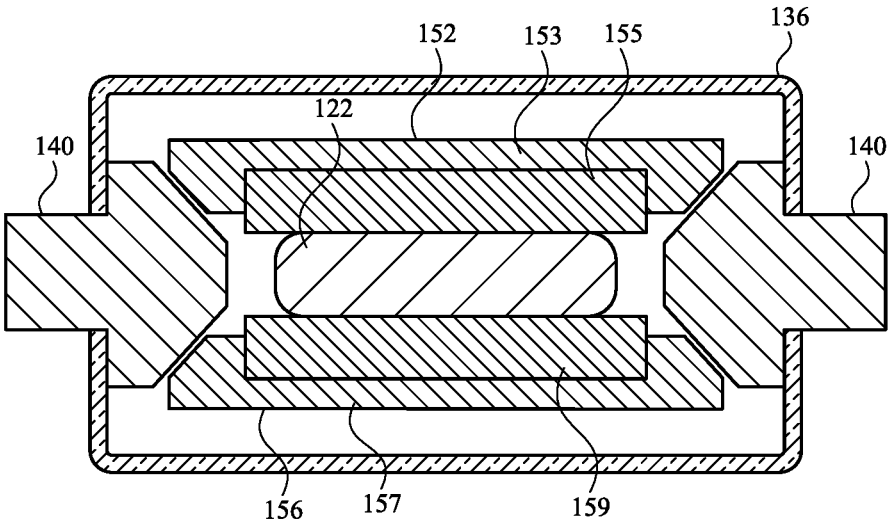
FIG. 15 is a sectional view of a connector and a watchband, in accordance with some embodiments of the present disclosure.
Figure 16:
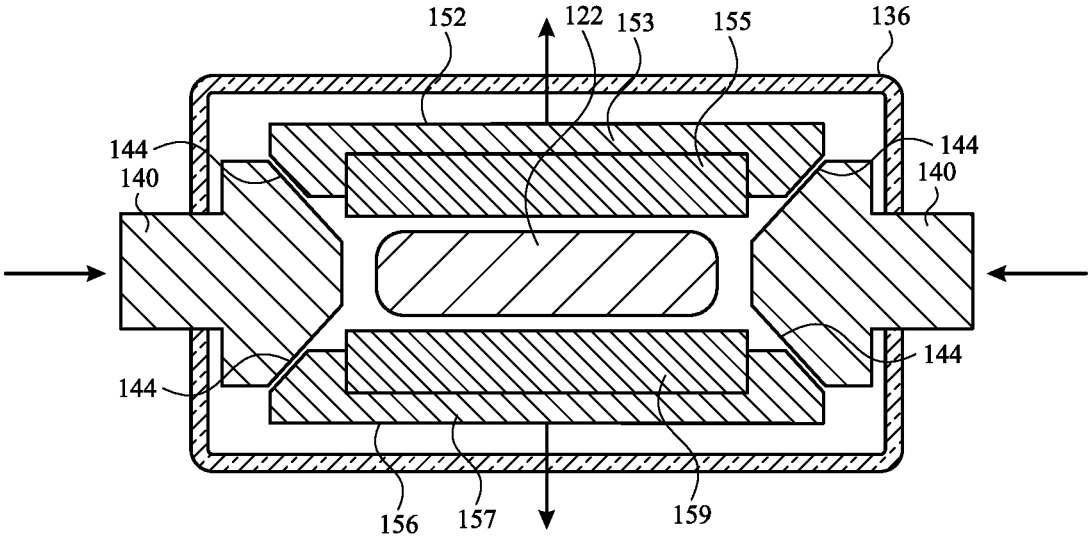
FIG. 16 is a sectional view of a connector and a watchband, in accordance with some embodiments of the present disclosure.

According to some embodiments, for example as shown in FIGS. 15 and 16, the first release button 140 and the second release button 141 are operable to achieve disengagement of the upper pad 152 and the lower pad 156 from the first watchband segment 122. When the first release button 140 and the second release button 141 are biased to an outward position, as shown in FIG. 15, the upper pad 152 and the lower pad 156 are permitted to contact and/or engaged the first watchband segment 122 as described above. For example, the first release button 140 and the second release button 141, while in an outward position, can avoid interference with application of the contact forces and engagement forces upon the first watchband segment 122. Each of the first release button 140 and the second release button 141 can be provided with a shoulder that limits outward movement thereof out of the housing 136 and/or the first rail 160 and the second rail 161. Accordingly, the biasing forces on the first release button 140 and the second release button 141 can bring the first release button 140 and the second release button 141 at rest in the outward position when not acted upon by a user.

The first release button 140 and the second release button 141 can be moveable by a user from the outward position to an inward position toward the first watchband segment 122, as shown in FIG. 16. With such action, the first release button 140 and the second release button 141 can apply a force to the upper pad 152 and the lower pad 156. Interface surfaces between each of the first release button 140 and the second release button 141 and each of the upper pad 152 and the lower pad 156 can translate the movement of the first release button 140 and the second release button 141 to movement of the upper pad 152 and the lower pad 156. For example, each of the first release button 140, the second release button 141 can include one or more sloped surfaces 144 for engaging the upper pad 152 and the lower pad 156. Accordingly, movement of the first release button 140 and the second release button 141 toward each other results in movement of the upper pad 152 and the lower pad 156 away from each other. While the first release button 140 and the second release button 141 are actuated, the contact forces and engagement forces of the upper pad 152 and the lower pad 156 on the first watchband segment 122 can be removed, such that a user can easily remove the first watchband segment 122 from the connector 130. When released, the first release button 140 and the second release button 141 can return to the outward position away from the upper pad 152 and the lower pad 156.

The first release button 140 and the second release button 141 can be operated to remove the watchband segment 122 from the housing 136 of the connector 130. Alternatively or in combination, the first release button 140 and the second release button 141 can be operated to adjust the first watchband segment 122 within the housing 136 of the connector 130. For example, while the first release button 140 and the second release button 141 are actuated, a user can move the watchband segment 122 within the housing 136 to reduce the tightness of the watchband on the user. The first release button 140 and the second release button 141 can be released when the desired tightness is achieved, and the connector can automatically re-engage the first watchband segment 122. Thus, adjustment can be simple and rapid with the use of the first release button 140 and the second release button 141.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A watchband connector comprising:

a housing for receiving a watchband segment;

a first guide rail opposite a second guide rail, each of the first guide rail and the second guide rail comprising upper guide grooves and lower guide grooves;

an upper pad comprising:

an upper escalator plate;

an upper engagement block for engaging a watchband segment; and upper pins on opposite sides of the upper escalator plate and extending in opposite directions away from the upper escalator plate, the upper pins being slidable within the upper guide grooves; and a lower pad comprising:

a lower escalator plate;

a lower engagement block for engaging the watchband segment; and lower pins on opposite sides of the lower escalator plate and extending in opposite directions away from the lower escalator plate, the upper pins being slidable within the lower guide grooves;

wherein, when the upper pad and the lower pad move in a first direction, the upper guide grooves and the lower guide grooves urge the entire upper pad and the entire lower pad toward each other on opposite sides of the watchband segment.

2. The watchband connector of claim 1, further comprising:

a connector housing with an inlet and an outlet and containing the first guide rail, the second guide rail, the upper pad, and the lower pad, wherein the watchband segment is a first watchband segment, wherein the first watchband segment is receivable between the first guide rail and the second guide rail, between the upper pad and the lower pad, and between the inlet and the outlet;

a second watchband segment attached to the connector housing and connectable to a watch housing;

springs biasing the upper pad and the lower pad toward each other; and release buttons moveable toward each other to move the upper and lower pads away from each other;

wherein the first guide rail comprises two upper guide grooves and two lower guide grooves;

wherein the second guide rail comprises two upper guide grooves and two lower guide grooves;

wherein each upper guide groove has an upper guide groove maximum dimension with a first end that is closer to the inlet and the lower guide grooves than is a second end that is opposite the first end;

wherein each lower guide groove has a has a lower guide groove maximum dimension with a first end that is closer to the inlet and the upper guide grooves than is a second end that is opposite the first end.

3. The watchband connector of claim 1, wherein the upper pad and the lower pad are biased toward each other.

4. The watchband connector of claim 1, wherein the upper engagement block comprises an upper planar surface and the lower engagement block comprises a lower planar surface, wherein the upper and lower planar surfaces are parallel to each other for engaging the watchband segment.

5. A watchband connector comprising:

a housing with an inlet and an outlet;

a first pad within the housing;

a second pad within the housing, wherein, when a watchband segment between the first and second pads is moved in a direction from the outlet toward the inlet, the first pad and the second pad move toward each other to clamp the watchband segment without plastically deforming the watchband segment; and release buttons on opposing sides of the housing, the release buttons being moveable toward each other and to positions interposed between the first pad and the second pad to directly engage and move the first pad and the second pad away from each other.

6. The watchband connector of claim 5, wherein, when the watchband segment is moved in the direction from the outlet toward the inlet, the first pad and the second pad move toward each other with respect to the housing.

7. The watchband connector of claim 5, wherein, when the watchband segment is moved in the direction from the outlet toward the inlet, engagement forces of the first pad and the second pad on the watchband segment are increased to prevent movement of the watchband segment out from between the first and second pads.

8. The watchband connector of claim 7, wherein, when the watchband segment is stationary between the inlet and the outlet, the first and second pads are biased to apply contact forces, less than the engagement forces, on the watchband segment.

9. The watchband connector of claim 5, wherein, when the segment is between the first pad and the second pad, the first pad and the second pad are biased toward the watchband segment.

10. The watchband connector of claim 5, wherein, when the watchband segment is moved in a direction from the inlet toward the outlet, the first pad and the second pad move away from each other to release the watchband segment.

11. The watchband connector of claim 5, further comprising rails within the housing and having guide grooves, wherein the first pad has pins on sides of the first pad to engage some of the guide grooves, and wherein the second pad has pins on sides of the second pad to engage some of the guide grooves.

12. The watchband connector of claim 5, further comprising release buttons moveable toward each other to move the first pad and the second pad away from each other.

13. A watchband connector comprising:

a housing having first guide grooves defined by first rails and second guide grooves defined by second rails;

a first pad having first pins engaging the first rails for sliding within the first guide grooves; and a second pad having second pins engaging the second rails for sliding within the second guide grooves, wherein the first pad and the second pad are biased toward each other by first spring element attached to one of the first pins and one of the second pins and a second spring element attached to another one of the first pins and another one of the second pins.

14. The watchband connector of claim 13, wherein, when the first pad and the second pad move in a first direction, the first guide grooves and the second guide grooves urge the first pad and the second pad toward each other.

15. The watchband connector of claim 13, further comprising a watchband segment attached to the connector housing and connectable to a watch housing.

16. The watchband connector of claim 13, further comprising release buttons moveable toward each other to move the first and second pads away from each other.

17. The watchband connector of claim 16, wherein the release buttons are biased away from the first and second pads.

18. The watchband connector of claim 13, wherein each first guide groove has an first guide groove maximum dimension with a first end that is closer to the inlet and the second guide grooves than is a second end that is opposite the first end, wherein each second guide groove has a has a second guide groove maximum dimension with first end that is closer to the inlet and the first guide grooves than is a second end that is opposite the first end.

* * * * *